US009175454B2

(12) United States Patent
Freitag et al.

(10) Patent No.: US 9,175,454 B2
(45) Date of Patent: Nov. 3, 2015

(54) FACING ELEMENT FOR REINFORCED SOIL STRUCTURE

(71) Applicant: TERRE ARMEE INTERNATIONALE, Velizy Villacoublay (FR)

(72) Inventors: Nicolas Freitag, Orsay (FR); Gilles Berard, Le Plessis Robinson (FR)

(73) Assignee: TERRE ARMEE INTERNATIONALE, Velizy Villacoublay (FR)

( * ) Notice: Subject to any disclaimer, the term of this patent is extended or adjusted under 35 U.S.C. 154(b) by 0 days.

(21) Appl. No.: 14/379,934

(22) PCT Filed: Aug. 19, 2013

(86) PCT No.: PCT/EP2013/053298

§ 371 (c)(1),
(2) Date: Aug. 20, 2014

(87) PCT Pub. No.: WO2013/124279

PCT Pub. Date: Aug. 29, 2013

(65) Prior Publication Data

US 2015/0030394 A1 Jan. 29, 2015

(30) Foreign Application Priority Data

Feb. 21, 2012 (EP) ..... 12305200

(51) Int. Cl.
*E02D 29/02* (2006.01)

(52) U.S. Cl.
CPC ..... *E02D 29/02* (2013.01); *E02D 29/0233* (2013.01); *E02D 29/0241* (2013.01)

(58) Field of Classification Search
CPC ..... E02D 29/0225; E02D 29/0233; E02D 29/0241; E02D 29/025; E02D 29/0266
USPC ..... 405/262, 284, 285, 286
See application file for complete search history.

(56) References Cited

U.S. PATENT DOCUMENTS

| | | | | |
|---|---|---|---|---|
| 4,674,921 | A | 6/1987 | Berger | |
| 4,728,227 | A * | 3/1988 | Wilson et al. | 405/284 |
| 5,505,563 | A * | 4/1996 | Curt | 405/262 |
| 5,580,191 | A | 12/1996 | Egan | |
| 5,782,582 | A * | 7/1998 | Oliver et al. | 405/262 |
| 7,029,204 | B1 * | 4/2006 | Webber et al. | 405/262 |
| 2007/0014638 | A1 | 1/2007 | Brown | |

* cited by examiner

*Primary Examiner* — Frederick L Lagman
(74) *Attorney, Agent, or Firm* — Dentons US LLP

(57) ABSTRACT

A facing element (10) for reinforced soil structure comprising: —first face (12) comprising at least a connecting member (14) configured to connect to said facing element at least one reinforcement member intended to reinforce the reinforced soil, —a second face (16) on which at least a protective membrane is intended to be applied, said second face is opposed to the first face, said second face has an essentially plane surface and comprises at least a fixing portion, the fixing portion comprising: —a contact surface (18) projecting from the plane surface of the second face, —a fastening element (20) anchored in the facing element and—a tightening element (22) engageable with the fastening element so as to fix the protective membrane between said tightening element and said contact surface.

14 Claims, 4 Drawing Sheets

FACING ELEMENT FOR REINFORCED SOIL STRUCTURE

Figure 1A:
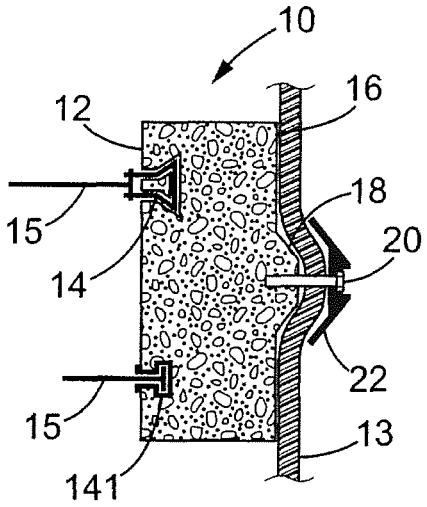

This application is a 35 U.S.C. §371 National Stage entry of International Application No. PCT/EP2013/053298, filed on Feb. 19, 2013, and claims priority to EP Application No. 12305200.3, filed Feb. 21, 2012, both of which are hereby incorporated by reference in their entireties as if fully set forth herein.

The present invention relates to the construction of stabilized earth, or reinforced soil, structures. In particular the invention relates to facing elements for reinforced soil structure, the reinforced soil structure itself and a method of construction of such reinforced soil structure.

The reinforced soil construction technique is commonly used to produce structures such as retaining walls or bridge abutments. This construction technique can also be particularly advantageous for producing structures such as dams, reservoirs etc. . . .

A stabilized earth structure combines a compacted fill, a facing and reinforcements usually connected to the facing.

Various types of reinforcement can be used: metal (for example galvanized steel), synthetic (for example based on polyester fibers), etc. They are placed in the earth with a density that is dependent on the stresses that might be exerted on the structure, the thrust of the soil being reacted by the friction between the earth and the reinforcements.

The facing is usually made of facing elements, for example prefabricated concrete elements, in the form of slabs or blocks, juxtaposed to cover the front face of the structure. There may be horizontal steps on this front face between various levels of the facing, when the structure incorporates one or more terraces.

The reinforcements placed in the fill are secured to the facing by mechanical connecting members that may take various forms. Once the structure is completed, the reinforcements distributed through the fill transmit high loads, that may range up to several tons. Their connection to the facing needs therefore to be robust in order to maintain the cohesion of the whole.

Various prior art solutions exist for fastening, by simple friction action, a protective membrane of plastic material against a surface area to be protected of a hydraulic structure, for example a dam or reservoir surface in contact with water.

Examples of such prior art fastening systems are disclosed in U.S. Pat. No. 5,143,480.

Such prior art fastening system presents some drawbacks, in particular caused by water infiltration under the protective membrane, owing to cuts and/or breakages caused in the same protective membrane; other breakage causes comprise the bulging of the protective membrane due to negative pressures generated by the wind action.

In all cases there was possible tearing of the protective membrane in the anchoring positions, as said fastening systems suffer to efficiently transmit to the hydraulic work the stresses caused by the water and/or wind force, without injuring the integrity of the protective membrane and the sealing action in the anchoring zones.

A prior art solution consisting in placing the protective membrane on the inside surface of a reinforced soil structure, that is the surface in contact with the earth, has been proposed, in particular in WO 2011/138105.

Although such solution provides good protective results, in particular for waterproof membranes, it presents some drawbacks.

One object of the present invention is to avoid the drawbacks cited above and in particular to provide a simple and low cost system of providing a protective membrane to a reinforced soil structure.

The invention proposes a facing element for reinforced soil structure comprising:

a first face comprising at least a connecting member configured to connect to said facing element at least one reinforcement member intended to reinforce the reinforced soil, a second face on which at least a protective membrane is intended to be applied, said second face is opposed to the first face, said second face has an essentially plane surface and comprises at least a fixing portion, the fixing portion comprising:

a contact surface projecting from the plane surface of the second face, a fastening element anchored in the facing element and a tightening element engageable with the fastening element so as to fix the protective membrane between said sealing element and said contact surface.

Advantageously, the fixing portion of the facing element according to the invention is an efficient and low cost mean for fastening the protective membrane against the second surface of the facing element.

Therefore, when building a reinforced soil structure using the facing element according to the invention one can easily and at low cost provide a protective membrane on the external surface of the structure, that is the surface intended to be in contact with either air or liquid.

According to various embodiments of the invention that can be considered alone or in combination:

the fixing portion is on an edge of the second face of the facing element, and/or the contact surface of the fixing portion projects away from the plane surface of the second face in a direction opposite to the first face, and/or the contact surface of the fixing portion projects away from the plane surface of the second face in the direction of the first face, and/or the tightening element has essentially the same shape as the contact surface, and/or the connecting member comprises a cavity in which is arranged a liquid-proof coating, said cavity forms a hollow space sealed to liquid and arranged to receive and connect part of the reinforcement member to the facing element, and/or the contact surface is a flattened cone or sawned-off cone surface or a spherical surface or a cylindrical surface.

The invention further relates to a reinforced soil structure comprising:

a fill;

a facing made of facing elements having a first face with at least a connecting member configured to connect to said facing element at least one reinforcement member intended to reinforce the reinforced soil, and a second face opposed to the first face, said facing element placed along a front face of the structure defined by the second face of the facing element; and each facing element being connected to at least one reinforcement member extending through a reinforced zone of the fill;

wherein the facing comprises at least two facing elements according to the invention sharing a protective membrane, and the front face of the structure is at least partly covered by the protective membrane fixed by the fixing portions to the at least two facing elements according to the invention.

According to various embodiments of the invention that can be considered alone or in combination:

the protective membrane is fixed to the facing elements by fastening the protective membrane between the tightening element and said contact surface, and/or the protective membrane is a waterproof membrane, and/or each facing element of the facing is either a facing element according to the invention or is in contact with at least one, for example at least two, for example at least three, facing elements according to the invention, and/or at least one row, or if there are more, at least the lower and higher rows of facing elements are made of facing elements according to the invention, and/or the fixing portions of the facing elements are covered by a patch sealed to the protective membrane fixed by said fixing portion, and/or an annular seal is provided between the protective membrane and the tightening element.

The invention further relates to a method for building a reinforced soil structure, comprising the steps of:

a) providing a facing element having a first face comprising at least a connecting member configured to connect to said facing element at least one reinforcement member intended to reinforce the reinforced soil structure and a second face (16) opposed to the first face, b) positioning the facing element so as to have the second face of the facing element along the front face of the structure delimiting a volume to be filled;

c) connecting at least one reinforcement member to a connecting member of the facing element so as to have the reinforcement member extending through a reinforced zone situated behind said front face, d) introducing fill material into said volume over, at least, the reinforced zone in which the reinforcement member extends, and compacting the fill material.

repeating steps a) to d), wherein at least two facing elements of the structure are according to the invention, and fixing a protective membrane to the front face of the structure using the fixing portions of the facing elements according to the invention.

According to an embodiment of the invention the protective membrane is fixed to the facing elements by fastening the protective membrane between the tightening element and said contact surface, and the method further comprises sealing a patch over the fixing portions of the facing elements.

Figure 2A:
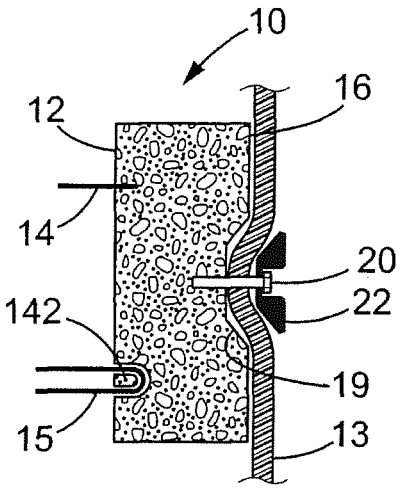
Figure 2B:
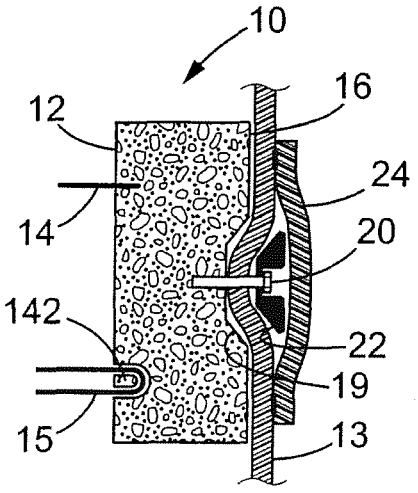
Figure 3:
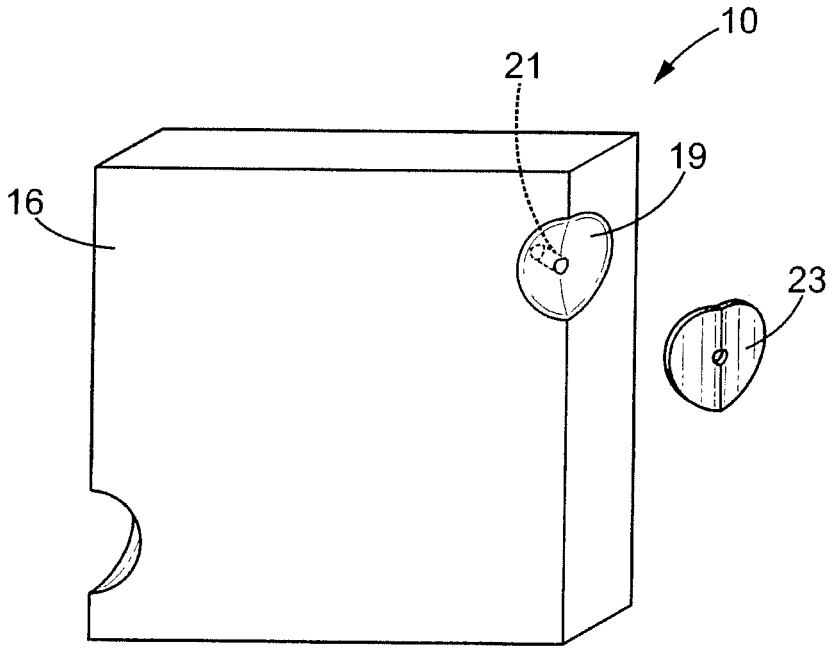
Figure 4:
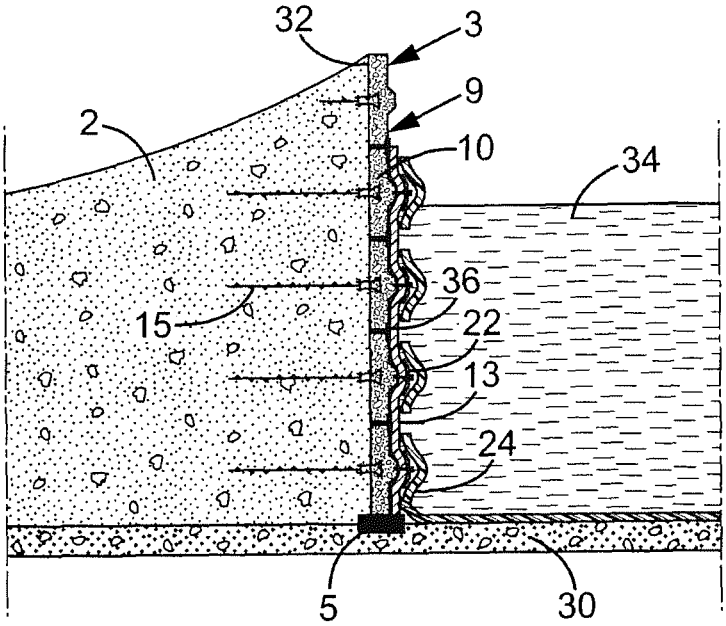
Figure 5:
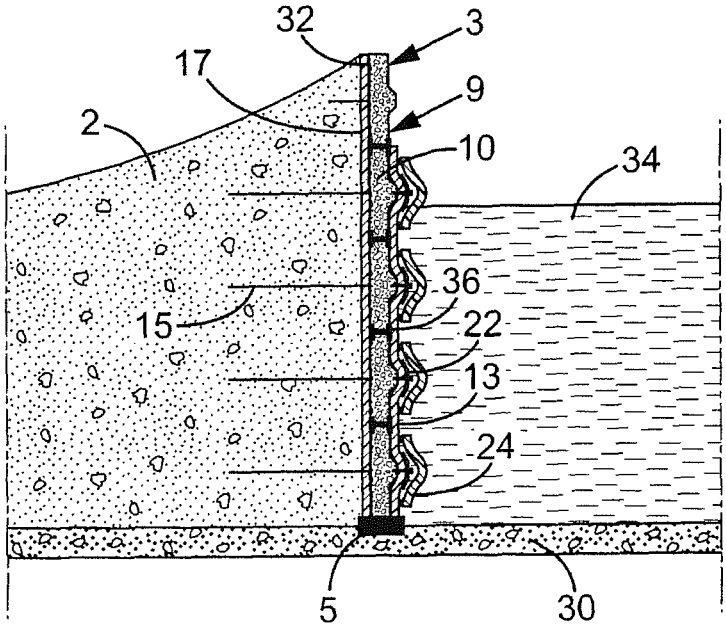
Figure 6:
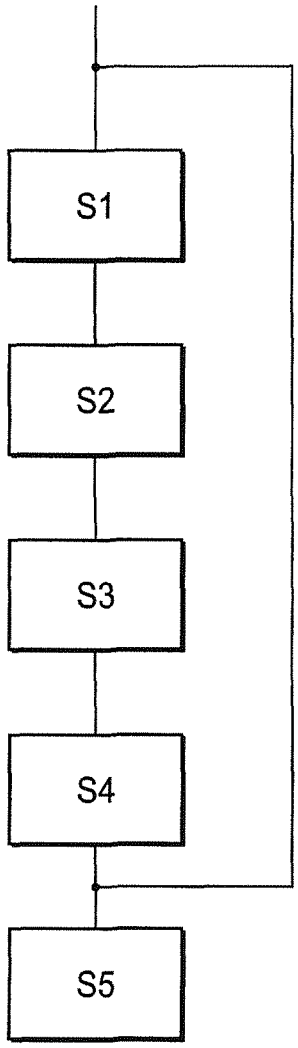

The invention will be better understood when considering the following description, given by way of example only and with reference to the appended drawings, in which:

FIGS. 1*a* to 2*c* are schematic representations in lateral section of facing elements according to different embodiments of the invention, FIG. 3 is a schematic representation of a side view of a facing element according to a third embodiment of the invention, FIG. 4 is a schematic view in lateral section of a stabilized earth structure according to an embodiment of the invention, FIG. 5 is a schematic view in lateral section of a stabilized earth structure according to a further embodiment of the invention, and FIG. 6 illustrates the steps of a method according to the invention.

For reasons of clarity, the various elements represented in the figures are not necessarily to scale. In these figures, identical references correspond to identical elements.

FIG. 1*a* represents a prefabricated facing element 10 according to a first embodiment of the invention. As represented on FIG. 1, the facing element 10 comprises a first face 12 and a second face 16 opposed to the first face 12, said second face comprises a fixing portion.

The first face 12 of the facing element 10 comprises a connecting member 14 configured to connect at least a reinforcement member 15 to said facing element 10. As represented on FIG. 1*a* the connecting member 14 may be an embedded connecting member projecting from the first face 12 as projecting tabs having aligned, vertical passageways therethrough.

Such reinforcement member reinforces the soil structure. Different types of reinforcements can be used: made of metal, for example galvanized steel strips or grids, or of synthetic material, such as stabilizing strips made for example of polyester fibres or polymeric grids.

The stabilizing reinforcements usually comprise longitudinal portions of elongate shape. Their length is of the order of one meter. They can be several meters in length.

The longitudinal portions of the reinforcements can be disposed in the soil one by one or assembled together by various means. The width and the thickness of such longitudinal portions are of the order of one centimeter and generally do not exceed about ten centimeters.

The longitudinal portions can be disposed substantially perpendicularly to the facing or inclined relative to the facing. As a general rule, the longitudinal portions of the reinforcements are disposed in a substantially horizontal plane.

The first face may further comprise a connecting member comprising a cavity 141 in which is arranged a liquidproof coating. The liquidproof coating, for example waterproof coating is arranged in the cavity 141 so as to cover the inside walls of the cavity. As illustrated on FIG. 1, said cavity forms a hollow space protected from liquids and arranged to receive and connect part of the reinforcement member 15 to the facing element. In the embodiment illustrated on FIG. 1, the cavity has a 'T' shape.

However, according to a further embodiment of the invention, the cavity may comprise a path formed for a reinforcement strip between two emergence points situated on a rear face of the facing. The path may comprise two adjacent portions respectively adjacent to the two emergence points and each disposed so as to position said strip in a respective emergence plane substantially perpendicular to the first face of the facing element. The two curved portions are provided as respective extensions of the two adjacent portions and are disposed so as to deviate the strip out of the emergence planes, and a connecting portion connecting together the two curved portions.

The two emergence planes may be identical and the connecting portion comprises at least one loop situated outside the unique emergence plane.

The two emergence planes may be distinct, separated by a physical separator and substantially parallel to each other in order to form top and bottom emergence planes, and the connecting portion comprises at least one loop situated outside the emergence planes and outside the space between said emergence planes.

According to an embodiment of the invention, the path may be covered with a protective coating, for example a waterproof coating.

Detailed examples of connecting members are disclosed in application WO2011/138105.

The second face 16 of the facing element 10 represented on FIG. 1*a* is opposed to the first face 12 and is intended to be at least partly covered with a protective membrane 13.

Said second face 16 has an essentially plane surface intended to be the front or external surface of a reinforced soil structure.

As illustrated on FIG. 1*a*, the facing element comprises a fixing portion intended to fix a protective membrane 13 to the facing element 10 so as to cover the second face 16 of said facing element 10.

The fixing portion comprises:

a contact surface 18 projecting from the plane surface of the second face 16, a fastening element 20 anchored in the facing element 10, and a tightening element 22 engageable with the fastening element 20 so as to fix the protective membrane 13 between said tightening element 22 and said contact surface 18.

The contact surface 18 projects away from the plane surface of the second face 16 in a direction opposite to the first face 12 of the facing element 10. Advantageously, according to such embodiment the thickness of the facing element 10 is not reduced by the presence of the contact surface 18.

According to the embodiment illustrated on FIG. 1*a*, the contact surface has a flattened cone shape.

In the sense of the invention a flattened cone shape is to be understood as defining a volume corresponding to a flattened cone or a sawn-off cone. Said cone may have a pyramidal, circular, square, rectangular or elliptical base.

As illustrated on FIG. 1*a*, a fastening element 20 is anchored to the facing element. The fastening element 20 may be anchored to the facing element at the small base of the flattened cone contact surface 18. But it could also be anchored to a side of the flattened cone contact surface 18 or on the surface 16 in the vicinity of the flattened cone contact surface 18.

The fastening element can be of any known kind, for example an anchor stud comprising a chemical fastening sheath or an anchor stud screwable into a finned tube, embedded in a cement mortar.

The fastening element 20 is engageable with a tightening element 22 so as to fasten the tightening element against the contact surface.

Figure 1B:
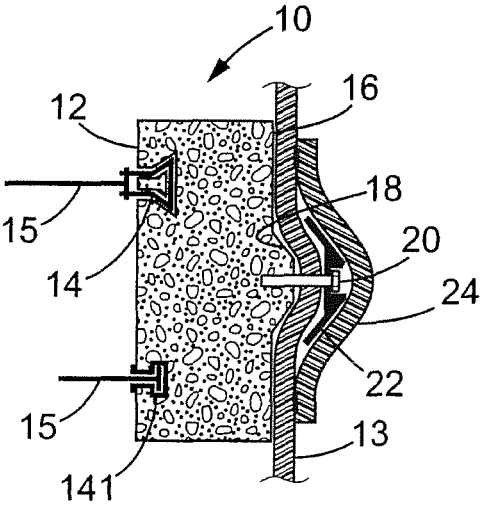
Figure 1C:
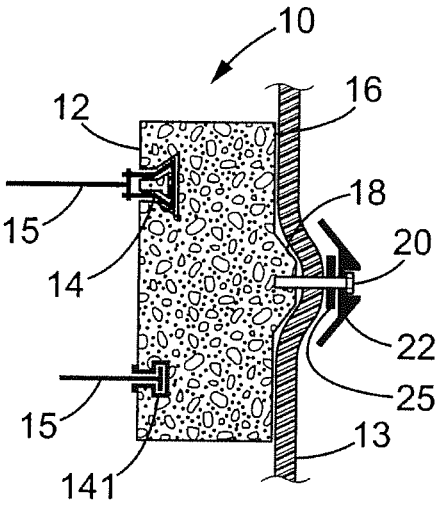
Figure 2C:
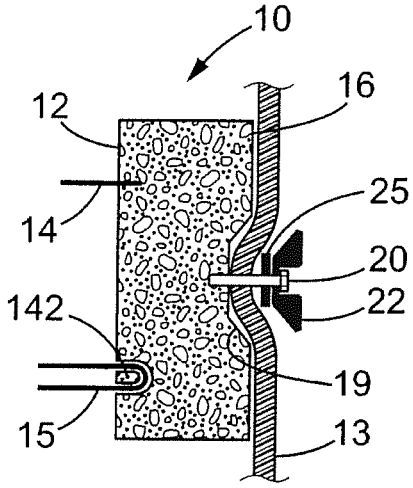

According to the embodiment illustrated on FIG. 1, the tightening element acts like a hood having essentially the same shape as the contact surface.

The tightening element 20 can be in plastic, for example thermoplastic, in resin, composite, concrete or fibre concrete, steel, aluminium or stainless steel.

As illustrated on FIG. 1*a*, the tightening element when engaged with the fastening element fastens a protective membrane 13 to the second face 16 of the facing element 10 by pressing, for example sealingly, the protective membrane 13 against the contact surface 18.

According to the invention, the protective membrane 13 is placed over the second face 16 of the facing element with the fastening element 20 that extends through a hole in the protective membrane 13.

The tightening element 22 is engaged with the fastening element 20 and is fastened against the contact surface 18 of the facing element 10, thus providing a sealing pressure on the protective membrane 13.

According to the invention, the protective membrane can for example be a waterproof protective membrane of synthetic resin material, or plastic material in general. Generally a protective membrane comprises an elastically flexible and extensible sheet of plastic material, commonly known as "geomembrane", e.g. made of polyvinyl-chloride (PVC), or high density polyethylene (HDPE), polypropylene (PP), or thermal polyolefins (TPO).

FIG. 2*a*, illustrates a facing element according to an embodiment of the invention similar to the facing element represented on FIG. 1*a*, except for the contact surface 19 projecting away from the plane surface of the second face 16 in the direction of the first surface 12.

Advantageously, the facing element 10 according to such embodiment is easy to fabricate. Indeed, the mould used to pour the concrete when fabricating the facing element does not require to be modified. Indeed, the facing element may be obtained by simply placing an element having the desired shape, for example a flattened cone element, a spherical element, or a cylindrical element either at the bottom of the mould prior to poring the concrete or on the facing element before the concrete is solidified. It can also be obtained by placing the tightening element 22 itself in the mould.

The first face 12 of the facing element illustrated on FIG. 2*a* further comprises a cavity 142 in which is arranged a liquid-proof coating. The cavity 142 has essentially the same features as the cavity 141 of the facing element represented on FIG. 1*a*. However the cavity 142 has a 'U' shape.

FIGS. 1*b* and 2*b*, illustrate facing elements similar to the facing elements represented on FIGS. 1*a* and 2*a* respectively, wherein a sealing patch 24, for example made of the same material as the protective membrane 13, is sealed to the protective membrane 13 over the tightening element 22. For example, the patch is a sheet made of the same material as the protective membrane that covers the tightening element and that is sealed to said protective membrane 13. FIGS. 1*b* and 2*b*, illustrate facing elements similar to the facing elements represented on FIGS. 1*a* and 2*a* respectively, wherein an annular seal 25, for example a plastic annular joint, is provided between the protective membrane 13 and the tightening element 22 so as to ensure the sealing at the fastening point.

As illustrated on FIG. 3, the fixing portion may be positioned on the edge of the second face 16 of the facing element. In other words, the fixing portion may be positioned halfway between the second face and the side of the facing element.

Advantageously, positioning the fixing means on the edge of the second face allows applying a protective membrane to a reinforced soil structure having an angle of less than 180° between two consecutive columns of facing elements, with the protective membrane always in contact with the external face of the reinforced soil structure.

In the embodiment illustrated on FIG. 3, the contact surface 19 of the fixing portion has a spherical shape. However, a flattened cone or cylindrical shape could be used.

As illustrated on FIG. 4, the invention also relates to a reinforced soil structure comprising facing elements 10 according to the invention.

The reinforced structure illustrated on FIG. 4 comprises:

a facing 3 extending from a substructure, which is the earth 30 in the example represented, said facing comprising a front face 9 against which rests an upstream area 34, a fill 2 for the structure, situated behind the facing, a protective membrane 13 between said facing 3 and the upstream area 34.

In the sense of the invention, the protective membrane 13 may consist of a single protective membrane or of a plurality of protective membranes sealed together.

The upstream area 34 may comprise a material such as a liquid, for example water, or polluted effluent.

In addition, said upstream area 34 may comprise waste from which toxic liquid materials may escape, or any other elements which are to be confined in front of the front face 9 of the structure 1. Without departing from the present invention, said upstream area 34 may contain light fluids like gazes.

The facing 3 is substantially vertical as illustrated in FIG. 4, and comprises a front surface substantially the same as the front face 9 of the structure and against which the protective membrane 13 rests, and a back surface 32 situated on the opposite side from the front surface.

The facing 3 is a concrete wall of any type of concrete known to the art. The wall may be constructed in a modular manner with facing elements 10, each of which is being connected to at least a reinforcement member 15 extending through a reinforced zone of the fill 2.

Each facing element 10 has a first face with at least a connecting member configured to connect to said facing element at least one reinforcement member reinforcing the reinforced soil and a second face opposed to the first face.

The facing elements are placed along the front face of the structure defined by the second face of the facing element.

The facing 3 may rest on a specific foundation 5 arranged at the base of the structure, which may ensures the fluid-tightness relative to the underlying soil.

At least part of the front face of the structure is covered with a protective membrane 13, for example a waterproof membrane. Furthermore, at least part of the substructure 30 is covered with a protective membrane continuously connected to the protective membrane 13 covering at least part of the front face of the structure.

According to the invention at least two facing elements of the reinforced structure are facing elements according to the invention, so as to fasten efficiently the protective membrane to the front face of the reinforced soil structure.

In the embodiment illustrated on FIG. 4, all of the facing elements 10 are facing elements according to the invention.

To limit the risk of damaging the protective membrane with the pressure of the liquid 34, one may place joints 36 between the facing elements that are covered with the protective membrane so as to provide the smoothest surface as possible for the protective membrane.

FIG. 5 represents a reinforced soil structure similar to the structure of FIG. 4 with in addition a protective membrane 17, for example waterproof membrane, on the inner face of the reinforced soil structure.

Advantageously, the additional inner protective membrane reduces the risk of leak in case the exposed membrane is damaged.

According to an embodiment of the invention the inner and front membranes can be sealed together using sealing bridges between different facing elements. Advantageously, in case of a leak the fluid penetration between the two membranes could be limited to the sealed area.

Leaks can be detected by providing detecting means between the two protective membranes. Detection means that may be used are thermometers or piezometers.

The reinforced structure illustrated in FIG. 5 can be obtained by a method as illustrated on FIG. 6.

Said method may comprise:

a facing providing step S1, a facing positioning step S2, a connecting step S3 filling step S4, and a membrane fixing step S5.

During the facing providing step S1, facing elements are provided, some of which are according to the invention.

Said facing elements are positioned so as to have the second face of the facing element along the front face of the structure delimiting a volume to be filled during the positioning step S2.

During the connecting step S3, at least one reinforcement member is connected to each facing element so as to have the reinforcement member extending through a reinforced zone situated behind said front face.

Fill material is introduced into said volume over, at least, the reinforced zone in which the reinforcement member extends, and compacted during the filling step S4.

The optional internal protective membrane is sealed to the inner surface of the structure. The sealing of the inner protective membrane is detailed in WO2011/138105.

The steps 1 to 4 are repeated so as to build the reinforced soil structure.

During the membrane fixing step a protective membrane is fixed to the front face of the structure using the fixing portions of the facing elements according to the invention.

For example a hole is made in the protective membrane and said membrane is placed over the fastening element. An annular plastic joint may be added over the protective membrane. The tightening element is engaged with the fastening element and fastened against the contact surface using the fastening element, thus, providing a sealing contact between the protective membrane and the contact surface.

If the protective membrane has another fixing point on the front face, the fastening of the tightening element also provides a small tension in the protective membrane reducing the risk of having wrinkles appear on the protective membrane.

A sealing patch may be added over the tightening element to insure a better seal of the protective membrane over the front surface.

As indicated previously, plastic joints may be positioned between each facing elements so as to provide a smoother front face surface for the protective membrane to rest on.

The invention is not limited to the embodiments described. There are a large number of possible variants of the structure and method described above. The above description is to be interpreted in a non limiting manner encompassing any equivalent embodiments.

The invention claimed is:

1. A facing element for reinforced soil structure comprising:

a first face comprising at least a connecting member to connect to said facing element at least one reinforcement member intended to reinforce the reinforced soil, and a second face on which at least a protective membrane is applied, said second face opposed to the first face, wherein said second face has an essentially planar surface and comprises at least a fixing portion, the fixing portion comprising:

a contact surface projecting from the planar surface of the second face, a fastening element anchored in the facing element, and a tightening element engageable with the fastening element so as to fix the protective membrane between said tightening element and said contact surface.

2. The facing element of claim 1, wherein the contact surface of the fixing portion projects away from the planar surface of the second face in a direction opposite to the first face.

3. The facing element of claim 1, wherein the contact surface of the fixing portion projects away from the planar surface of the second face in the direction of the first face.

4. The facing element of claim 1, wherein the tightening element has essentially the same shape as the contact surface.

5. The facing element of claim 1, wherein the connecting member comprises a cavity in which is arranged a liquid proof coating, said cavity forming a hollow space sealed against liquid intrusion and arranged to receive and connect part of the reinforcement member to the facing element.

6. The facing element of claim 1, wherein the contact surface is a flattened cone surface, a spherical surface, or a cylindrical surface.

7. The facing element of claim 1, wherein the fixing portion is on an edge of the second face of the facing element.

8. A reinforced soil structure comprising:

a fill, a facing made of facing elements having a first face with at least a connecting member configured to connect to said facing element at least one reinforcement member intended to reinforce the reinforced soil and a second face opposed to the first face, wherein said facing element is placed along a front face of the structure defined by the second face of the facing element; and each facing element being connected to at least one reinforcement member extending through a reinforced zone of the fill;

wherein the facing comprises at least two facing elements sharing a protective membrane, wherein, for each facing element, the second face has an essentially planar surface and comprises at least a fixing portion, the fixing portion comprising:

a contact surface projecting from the planar surface of the second face, a fastening element anchored in the facing element, and a tightening element engageable with the fastening element so as to fix the protective membrane between said tightening element and said contact surface, and wherein the front face of the structure is at least partly covered by said membrane fixed by the fixing portions to the at least two facing elements.

9. The structure of claim 8, wherein the protective membrane is fixed to the facing elements by fastening the protective membrane between the tightening element and said contact surface.

10. The structure of claim 8 further comprising at least one row of facing elements, wherein each facing element comprises:

a first face comprising at least a connecting member to connect to said facing element at least one reinforcement member intended to reinforce the reinforced soil, and a second face on which at least a protective membrane is applied, said second face opposed to the first face, wherein said second face has an essentially planar surface and comprises at least a fixing portion, the fixing portion comprising:

a contact surface projecting from the planar surface of the second face, a fastening element anchored in the facing element, and a tightening element engageable with the fastening element so as to fix the protective membrane between said tightening element and said contact surface.

11. The structure of claim 8, wherein the fixing portions of the facing elements are covered by a patch sealed to the protective membrane fixed by said fixing portion.

12. The structure of claim 8, wherein an annular seal is provided between the protective membrane and the tightening element.

13. A method for building a reinforced soil structure, comprising the steps of:

a) providing a facing element having a first face comprising at least a connecting member to connect to said facing element at least one reinforcement member intended to reinforce the reinforced soil structure and a second face opposed to the first face, b) positioning the facing element so as to have the second face of the facing element along the front face of the structure delimiting a volume to be filled;

c) connecting at least one reinforcement member to a connecting member of the facing element so as to have the reinforcement member extending through a reinforced zone situated behind said front face, d) introducing fill material into said volume over, at least, the reinforced zone in which the reinforcement member extends, and compacting the fill material, repeating steps a) to d), wherein at least two facing elements of the structure comprises:

a first face comprising at least a connecting member to connect to said facing element at least one reinforcement member intended to reinforce the reinforced soil, and a second face on which at least a protective membrane is applied, said second face opposed to the first face, wherein said second face has an essentially planar surface and comprises at least a fixing portion, the fixing portion comprising:

a contact surface projecting from the planar surface of the second face, a fastening element anchored in the facing element, and a tightening element engageable with the fastening element so as to fix the protective membrane between said tightening element and said contact surface, and fixing a protective membrane to the front face of the structure using the fixing portions of the facing elements.

14. The method of claim 13, wherein the protective membrane is fixed to the facing elements by fastening the protective membrane between the tightening element and said contact surface, and the method further comprises sealing a patch over the fixing portions of the facing elements.

* * * * *